United States Patent [19]

Kutz et al.

[11] 4,310,113

[45] Jan. 12, 1982

[54] APPARATUS AND METHOD FOR STORAGE AND REACTION TREATMENT OF TEXTILE MATERIAL IN WEB FORM

[75] Inventors: Johannes Kutz, Tönisvorst; Manfred Moser, Krefeld-Fischeln, both of Fed. Rep. of Germany

[73] Assignee: Eduard Küsters, Krefeld, Fed. Rep. of Germany

[21] Appl. No.: 132,105

[22] Filed: Mar. 20, 1980

[30] Foreign Application Priority Data

Aug. 7, 1979 [DE] Fed. Rep. of Germany ..... 2931990

[51] Int. Cl.[3] ..... D06B 3/10

[52] U.S. Cl. ..... 226/4; 68/158; 68/177; 226/118

[58] Field of Search ..... 68/158, 177; 8/152; 226/4, 118, 119

[56] References Cited

U.S. PATENT DOCUMENTS 3,457,029 7/1969 Drago ..... 68/177 X

FOREIGN PATENT DOCUMENTS 1346598 11/1963 France ..... 68/177

*Primary Examiner*—Philip R. Coe

*Attorney, Agent, or Firm*—Kenyon & Kenyon

[57] ABSTRACT

In a device for the storage and reaction treatment of textile material in web form for continuous passage which includes a cylinder, a transporting device for transporting the textile material onto the surface of the cylinder in the circumferential direction thereof, a pleating device for pleating the textile material in several layers with folds parallel to the axis of the cylinder onto the top of the cylinder, a depositing device arranged underneath the cylinder, and a pulling off device for pulling the textile material off at a point following the lower crest of the cylinder in the travel direction, dissolving the folded layers, the velocities of the transporting device and the pleating device and the stroke of the pleating device are controlled such that the folded layers extend at least one-third on both sides of the upper crests of the cylinder and that the length of a folded layer from one fold to another fold is one-quarter to one-half of the cylinder circumference, and that the folded layers cover each other on at least two-thirds of their length.

10 Claims, 4 Drawing Figures

APPARATUS AND METHOD FOR STORAGE AND REACTION TREATMENT OF TEXTILE MATERIAL IN WEB FORM

BACKGROUND OF THE INVENTION

This invention relates to the treatment of textile material in general and more particularly to an improved apparatus for the storage and reaction treatment of textile material in web form.

Devices for the storage and reaction treatment of textile material in web form for continuous passage including a transporting device for transporting the textile material on the surface of a cylinder in the circumferential direction thereof, a pleating device for pleating the textile material in several layers with folds parallel to the axis of the cylinder onto the top of the cylinder, a depositing device arranged underneath the cylinder, and a pulling-off device for pulling the textile material off at a point following the lower crest of the cylinder in the travel direction, dissolving the folded layers are known from Swiss Pat. No. 421,653 and from German Pat. No. 14,60,496. In both known designs the folds of the pleating have a relatively short length when pleated onto that part of the upper portion of the cylinder which faces the descending side when it rotates. The stack of folds is turned during the passage under the lower crest of the cylinder so that the material can be taken off from the top side of the stack of folds by pulling off device.

So that the stack of folds is maintained approximately in order and does not fall off on the side of the cylinder, additional measures are required in both above-described designs. In Swiss Pat. No. 421,653, a screen belt runs along parallel to the circumference of the cylinder so that, during its rotation, the stack of folds is held between the circumference of the cylinder and said screen belt. In German Pat. No. 14,60,496, such an additional belt which runs along on part of the revolution may also be provided, but the order of the packet of folds is predominently maintained by designing the cylinder as a sieve an subjecting its interior to under pressure so that the material is sucked onto the circumference of the cylinder and is held there in this manner.

In all devices of the type under discussion, the basic idea is to subject a continuously running textile material to a storage and reaction treatment of a given duration. For this purpose a packet of the material is formed and the packet is conducted through the storage and reaction machine relatively slowly. However, the material must subsequently be transferred from the packet into a running web again without complication.

In the known design, this requires a considerably amount of equipment since the cylinders alone are not capable of maintaining the order of the folded layers.

It is an object of the present invention to develop a device of the type described above in such a manner that a storage and reaction treatment is possible with fewer additional units while retaining the ordered position of the packet of folds.

SUMMARY OF THE INVENTION

According to the present invention, this problem is solved by controlling the velocities of the transporting device and the pleating device and the stroke of the pleating device such that the folded layers extend at least one-third on both sides of the upper crests of the cylinder and that the length of a folded layer from one fold to another fold is one-quarter to one-half of the cylinder.

The particular length of the folds is important in this solution. The material should be deposited, in pleating, on both sides of the crest of the cylinder on its surface. Each succeeding folded layer covers the preceding layer of folds to a considerable extent. During the transport of the packet of folded layers in the circumferential direction, the lowest layers of folds, i.e., those which are adjacent to the cylinder, are pressed against the surface of the cylinder by the weight of the next layer of folds resting thereon and are held in place in this manner or are prevented from falling down on the side of the cylinder to make a disordered pile. Rather, the lower ends of the inner layer of folds already hang down on the side of the cylinder to beyond the lower crest, while the same layer of folds further up is still held by the succeeding layers of folds. In this manner the folded layers arrive in an orderly manner at a deposition device, from which they are subsequently pulled off. This is accomplished merely by proper design of the length of the folds and the speeds of the pleating device and the cylinder, without additional measures being necessary. The cylinder therefore is not a suction cylinder but not only a normal sieve cylinder. An additional conveyor device, for instance, in the form of a conveyor belt which first engages the textile material in web form on the side of the cylinder is also not necessary.

In a machine with a deposition device which is designed as a tray that can be filled with liquid, and which is known by itself from Swiss Pat. No. 421,653, a screen belt conducted around the lower part of the cylinder may be provided. This provides gentle and uniform pressure of the layers of folds conducted between the screen belt and the circumference of the cylinder onto the surface of the cylinder.

According to another embodiment a conveyor belt may be provided under the cylinder, as is known per se from German Pat. No. 1,460,496. The folds hanging down on the side of the cylinder are transported with their lower ends on the conveyor belt in the travel direction during rotation and are taken along by the belt under the crest of the cylinder, while in the upper portion they are still held on the surface of the cylinder by the pressure of the succeeding layers of folds. In this manner, the packet of folds is directed into the curve under the cylinder.

To aid the adhesion of the textile material in web form to the surface of the cylinder, bars can be arranged parallel to the axis on the surface of the cylinder.

The entire circumference of the cylinder can also be formed by rods extending parallel to the axis instead of by perforated sheet metal, wire mesh or the like. This embodiment has advantages because the package of textile web material is also particularly accessible from the inside, for instance, for spraying devices and the like.

When "cylinders" are mentioned in the present context, this naturally means first of all, a structure which rotates as a whole about a central axis and in this manner brings about the conveyor effect along its circumference. The same effect is obtained, however, if the cylinder is formed by rods which can rotate about their own axes and are fixedly supported parallel to the central shafts on a circle. The cylinder as a whole is then, so to speak, stationary.

The conveyor effect over the circumference of the circle is produced by the rotary motion of the individual rods which are driven in a controlled manner, so that a desired lead or lag can be adjusted.

In this design, finally, an embodiment according to the present invention in which the rods are designed to facilitate transport is of advantage. The improved transport can be accomplished by making the cross-section polygonal, for instance, linings on the surface of the rods such as by a plastic coating or the like provided with longitudinal ribs which increase friction.

DETAILED DESCRIPTION OF THE INVENTION

Figure 1:
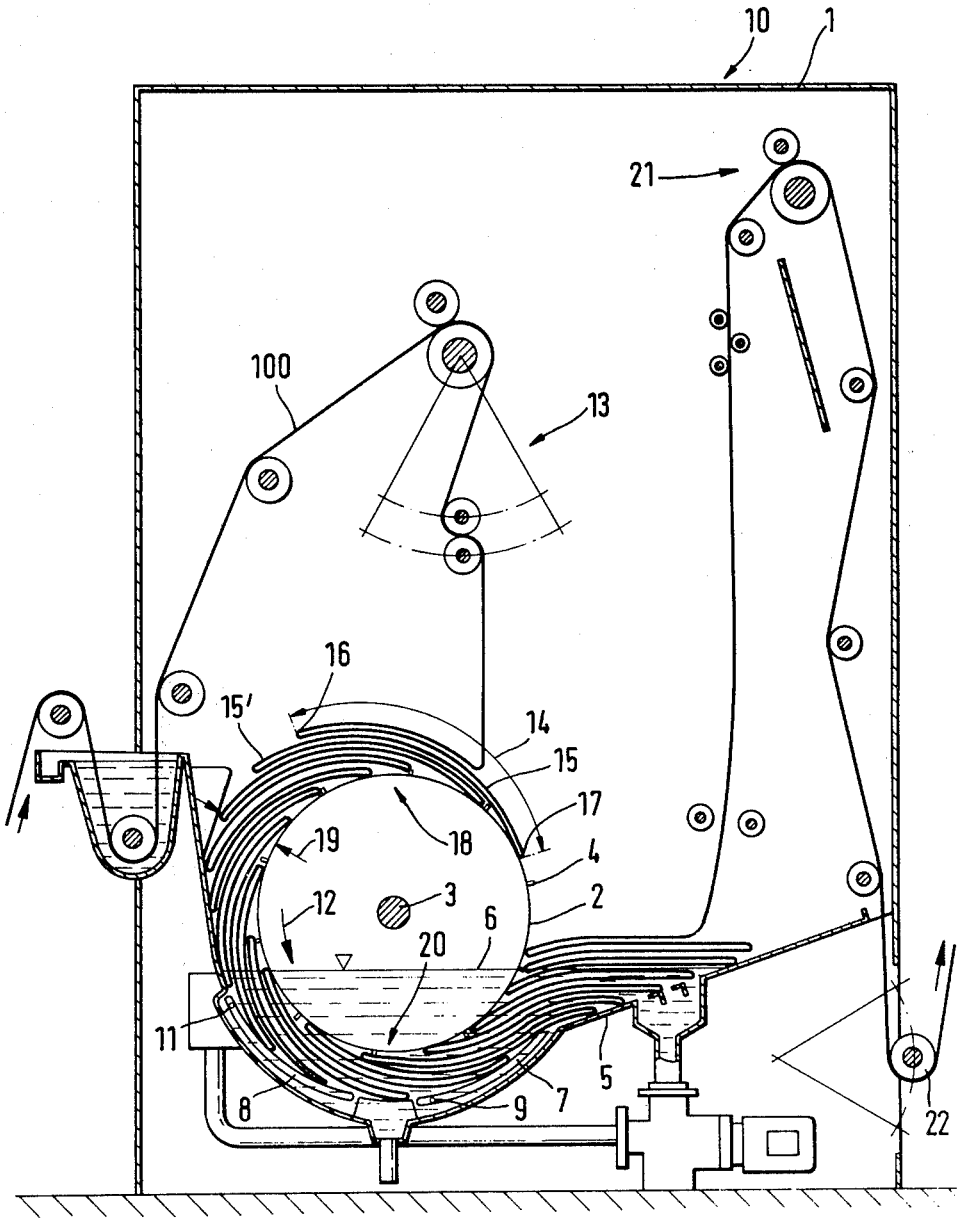
FIGS. 1 to 4 are schematic vertical, longitudinal sections through four different embodiments according to the present invention.

The machine 10 of FIG. 1 comprises a housing 1 in which a sieve cylinder 2 is supported for rotation about a shaft 3. Underneath the sieve cylinder 2 a closed tray 5 is arranged at some distance from the circumference of the cylinder; it contains a treatment liquor 6. On the bottom of the tray 5, floats 7 and 8 are pivoted about points 9 and 11 and tend to rise in the liquid and thereby swing about the points 9 and 11. In FIG. 1, the pivots 9 and 11 are linked at the ends of the floats 7 and 8 located opposite to the travel direction 12; but this is not absolutely necessary.

Above the sieve cylinder 2 is a pleating device 13. Pleating device 13 pleats the incoming web of material 100 into folds on the top side of the cylinder 2. The pleating device 13 has a stoke such that the length 14 of a folded layer 15 between the leading fold 16 and the lagging fold 17 is between one-quarter and one-half of the circumference of the cylinder 2. The folded layers 15 are therefore relatively long as compared to the customary lengths of folds. In addition, the pleating device 13 is arranged so that each layer of folds has at least one-third of its length extending on each side of the top crest 18 of the cylinder 2. Finally, this folded layer 15 must cover up the preceding folded layer 15 over at least two-thirds of its length. Thereby, a certain minimum number of folded layers lying one above each other is obtained, i.e., a packet 19 of layers of folds is obtained. The packet of layers of folds is carried along in the travel direction 12 when the cylinder 2 rotates, and is transported to beyond the lower crest 20 of the cylinder where it is turned so that the layers of folds which were originally closest adjacent to the cylinder in its upper region come to lie on top and can be pulled off from the top side of the packet of layers of folds by a pulling off device 21. The pulling off velocity is regulated either by a compensating roller 22 or by the floats 7 which are pressed down to different depths depending on the weight resting on them, which motion can be utilized for control.

So that the described properties of the layers of folds 15 are realized, the speed of rotation of the cylinder 2 as well as the operating speed of the pleating device 13 must be controlled according to the arrival velocity of the web 100 of the textile material.

Figure 2:
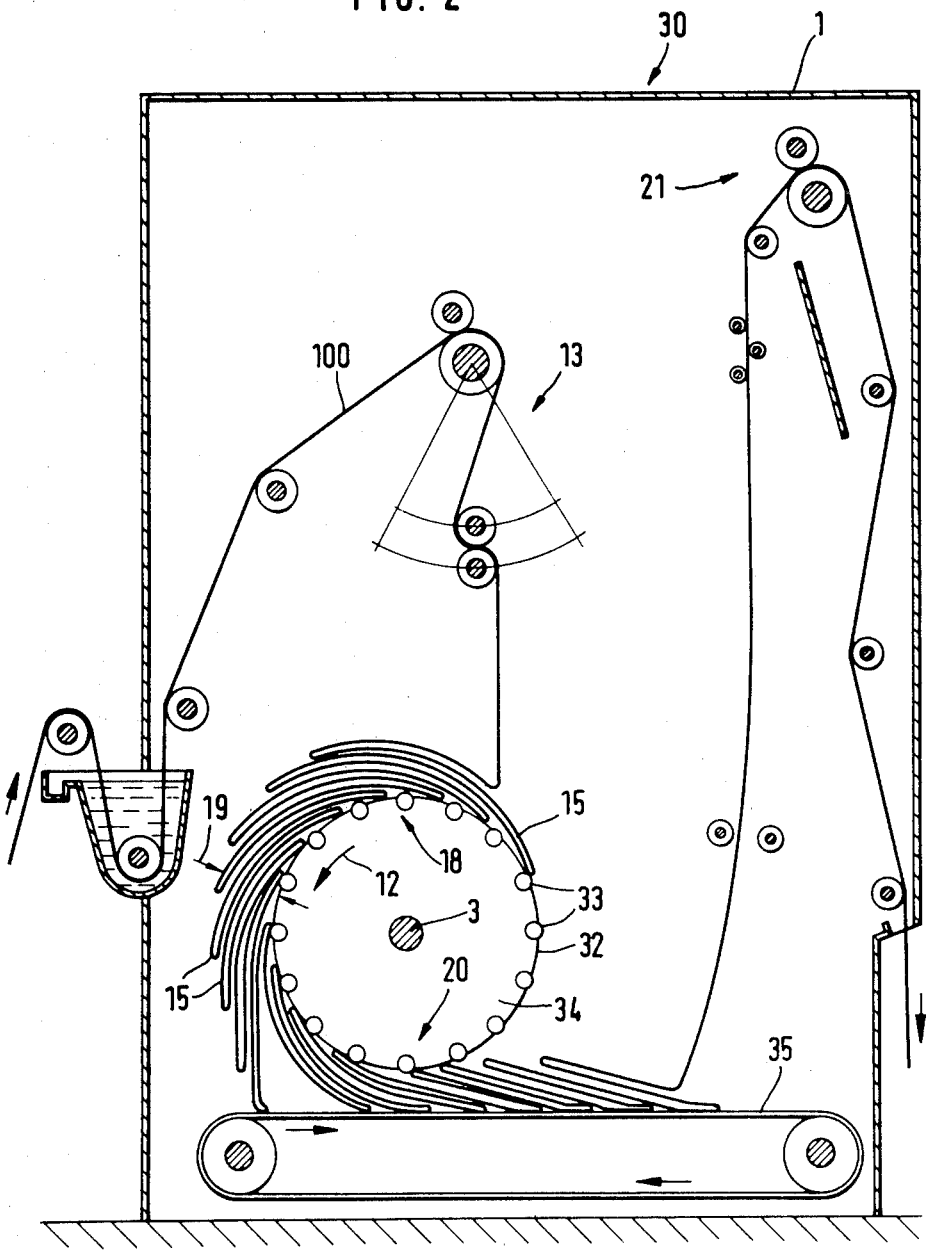

In FIG. 2, a modified embodiment in the form of a machine 30 is shown in which the cylinder 2 is replaced by a cylinder 32, the circumference of which is formed by rods 33 arranged parallel to the central shaft. Rods 33 are attached to end discs or end rings 34 with mutual spacing in the circumferential direction. The rods 33 cannot rotate about their own axes but can rotate about the shaft 3 with the entire cylinder 32.

The depositing device is not formed, as in the embodiment of FIG. 1, by a liquid filled tray 5, but by an endless revolving conveyor belt 35, onto which the folded layers 15, hanging down at the side of the cylinder, arrive with their own ends, and are then carried to the right by the conveyor belt 35 according to FIG. 2, so that the package of folded layers is transported under the lower crest 20 of the cylinder 32, substantially horizontally, to a position below the pulling off device 21, as can be seen schematically in FIG. 2. Because the packet of folded layers has been turned in the process, the folded layers 15 which were placed first and are immediately adjacent to the circumference of the cylinder, comes to the top and can be pulled off easily.

With respect to the development of the folded layers 15, the device 30 corresponds to the device 10.

Figure 3:
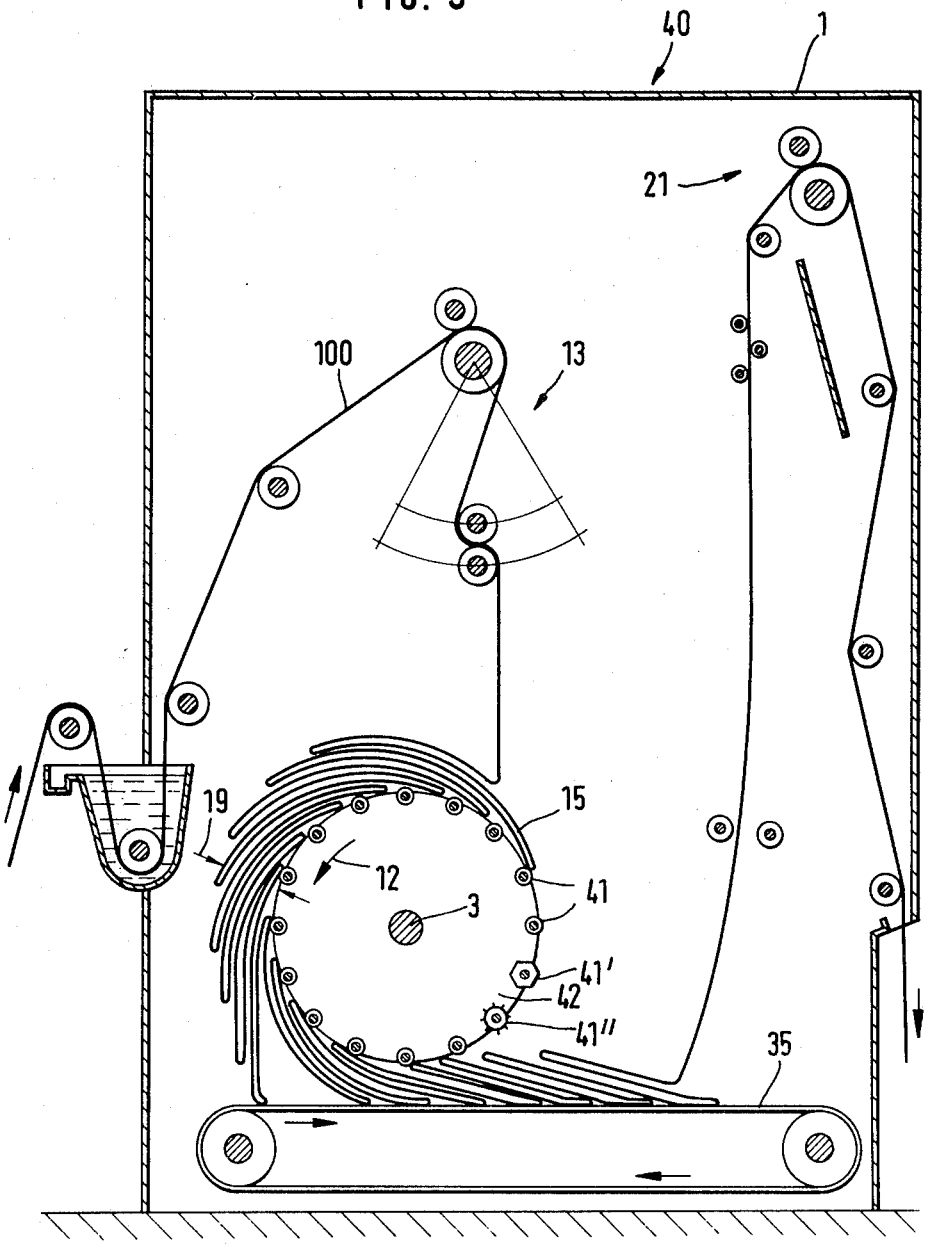

In FIG. 3, a device 40 is shown, in which the cylinder-like transport device 42 which is formed in the devices 10 and 30 by actually revolving cylinders 2 or 32, consists of driven rods 41 which are supported in a stationary manner but are rotatable about their own axes. The rods are arranged on a circle, parallel to the central shaft 3 and form a transport device which moves the package 19 of folded layers in the travel direction 12 in the same manner as is the case of cylinders 2 and 32.

In order to provide good adhesion of the packet of folded layers on the rods 41, the rods may also have polygonal cross-section as is shown at 41', or have a covering with ribs parallel to the axis in the manner or rod 41''. Such rods, which assist with the transport, may also be provided in the device 30.

Also in the device 40, the development of the folded layers 15 and their transport around the circumference of the transporting device 42 and onto the conveyor belt 35 corresponds to the device 10.

Figure 4:
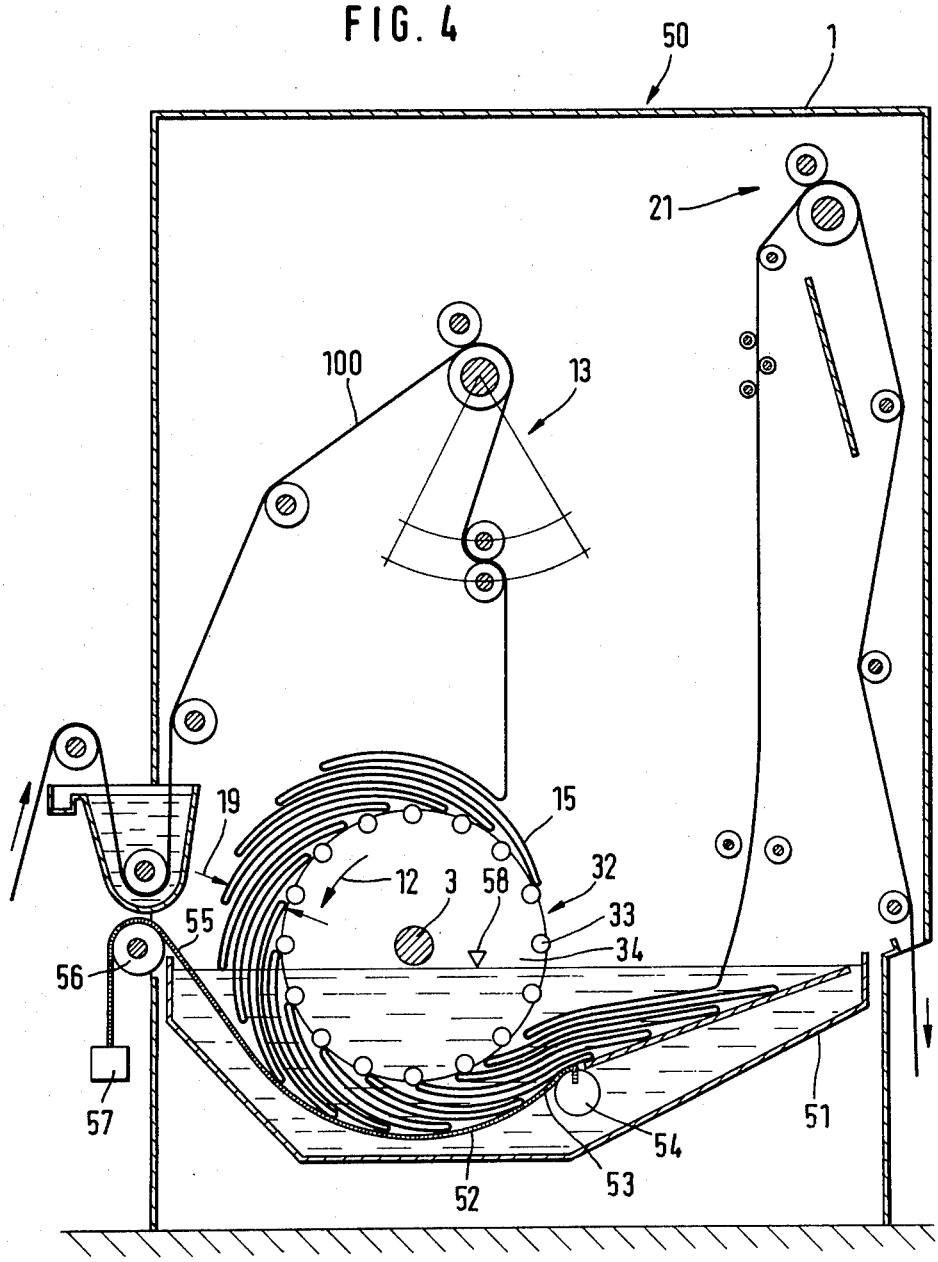

In the device 15 of FIG. 4, a cylinder 32 equipped with rods 33 according to FIG. 2 is again provided. The cylinder 32 has in its lower portion a tray 51 which is filled with liquid up to a level 58. Underneath the cylinder 32 is a screen belt 52 covered with PTFE. Belt 52 extends over the width of cylinder 32 and is secured at its right hand end 53 to a tube 54 which is fixed with respect to the housing 1 and extends parallel to the shaft 3 over the width of the arrangement. It is disposed at a distance from the cylinder 32 to the right outside thereof, i.e., toward the side of the pulling off device 21. At the bottom, the screen belt 52 is looped freely around the cylinder 32 and is conducted up on the entrance side and over a rotatable roller 56 which extends across the width of the web parallel to the shaft 3. Weights 57 are fastened to the free end of the screen belt 52, which hangs down on the other side of the roller 56. Weights 57 exert a pull on the screen belt 52 in its lengthwise direction.

The packet of folded layers carried along by the cylinder 32 is immersed into the liquid and thereby practically becomes weightless. The screen belt 52 follows the contour of the packet of folded layers, which floats in the liquid and is being carried along by the cylinder 32, from the outside and keeps it in contact with the cylinder 32. This requires only relatively small forces which are supplied by the weight 57. It also does not matter much whether the packet 19 of folded layers is thicker or thinner since the weight of the folded layers is practically compensated in any event by the buoyancy, and the screen belt 52 can adapt itself to different thicknesses of the packet 19 of folded layers, due to its resilient support at the end 55. The screen belt 52 follows the contour of the packet 19 of folded layers tangentially approximately at the height of the liquid level.

It is merely a matter of a mechanical design that the resilient end 55, in this embodiment, is provided on the entrance side, with the travel direction 12, and that the end 53 which is fixed to the housing, is provided on the exit side. The arrangement can also be made in the reverse. Here, too, this embodiment is not tied to the design of the cylinder 32 but can also be operated, for instance, with the cylinder designs 2 and 42.

What is claimed is:

1. A device for the storage and reaction treatment of textile material is web form for continuous passage comprising:

(a) a cylinder;

(b) a pleating device for pleating the textile material in several layers with folds parallel to the axis of the cylinder onto the top of the cylinder;

(c) a transporting device for circumferentially transporting the textile material deposited on said cylinder;

(d) a depositing device arranged underneath the cylinder;

(e) a pulling off device for pulling the textile material off at a point following the lower crest of the cylinder in the travel direction, dissolving the folded layers; and (f) means controlling the velocities of said transporting device and said pleating device and the stroke of said pleating device such that the folded layers extend at least one-third on both sides of the upper crests of the cylinder and that the length of a folded layer from one fold to another fold is one-quarter to one-half of the cylinder circumference, and that the folded layers cover each other on at least two-thirds of their length.

2. A device according to claim 1, wherein said depositing device comprises a tray which can be filled with liquid, and further including a screen belt which extends over the width of the textile material and is conducted around the lower part of the cylinder, disposed in said tray under the cylinder, said belt being secured at one end along a transversal line in the housing, and said belt being resiliently attached in the direction of said belt at its other end, but otherwise free.

3. A device according to claim 2, and further including weights attached to and tensioning said belt at said resiliently attached end.

4. A device according to claim 1, and further including an endless conveyor belt, which revolves in the same direction and with the same circumferential velocity as the cylinder, disposed at the lower crest under said cylinder.

5. A device according to claim 1, wherein said cylinder is a revolving cylinder having perforated material at its circumference and having bars which extend parallel to its axis on its outside circumference.

6. A device according to claim 1, wherein said cylinder is a revolving cylinder with a surface formed by rods extending parallel to its axis.

7. A device according to claim 1, wherein said cylinder is formed by rods which are supported fixed on a circle and are arranged parallel to the axis of said cylinder said rods rotatable about their own axes.

8. A device according to claim 7 and further including means to drive said rods in a controlled manner.

9. A device according to claim 8, wherein said rods have an irregular surface adapted to assist the transport.

10. A method of operating a device for the storage and reaction treatment of textile material in web form for continuous passage which includes:

(a) a cylinder;

(b) a pleating device for pleating the textile material in several layers with folds parallel to the axis of the cylinder onto the top of the cylinder;

(c) a transporting device for circumferentially transporting the textile material deposited on said cylinder;

(d) a depositing device arranged underneath the cylinder; and (e) a pulling off device for pulling the textile material off at a point following the lower crest of the cylinder in the travel direction, dissolving the folded layers comprising: controlling the velocities of said transporting device and said pleating device and the stroke of said pleating device such that the folded layers extend at least one-third on both sides of the upper crests of the cylinder and that the length of a folded layer from one fold to another fold is one-quarter to one-half of the cylinder circumference, and that the folded layers cover each other on at least two-thirds of their length.

* * * * *